US005469718A

United States Patent [19]

Gutschmit

[11] Patent Number: 5,469,718

[45] Date of Patent: Nov. 28, 1995

[54] DEBRIS CLEANING APPARATUS FOR CIRCULAR KNITTING MACHINES AND LIKE TEXTILE MACHINES

[75] Inventor: Alan Gutschmit, Troy, N.C.

[73] Assignee: Alandale Industries, Inc., Troy, N.C.

[21] Appl. No.: 323,034

[22] Filed: Oct. 13, 1994

[51] Int. Cl.[6] ..... D04B 35/32

[52] U.S. Cl. ..... 66/168; 15/301; 416/110

[58] Field of Search ..... 66/168; 15/301, 15/312, 342, 405; 416/110

[56] References Cited

U.S. PATENT DOCUMENTS

| | | | |
|---|---|---|---|
| 1,224,218 | 5/1917 | Scheibe | 416/110 |
| 1,226,076 | 5/1917 | Jennings | 415/110 |
| 1,332,875 | 3/1920 | Ainsworth . | |
| 1,939,481 | 12/1933 | Albers | 416/110 |
| 1,987,582 | 1/1935 | Terrell | 15/405 |
| 2,063,873 | 12/1936 | Hodge | 15/312.1 |
| 2,063,874 | 12/1936 | Hodge | 15/312.1 |
| 2,458,098 | 1/1949 | Primeaux | 416/110 X |
| 2,610,349 | 9/1952 | Moore | 15/312 |
| 2,705,538 | 4/1955 | Russo | 416/110 |
| 2,976,557 | 3/1961 | King, Jr. | 15/312 |
| 3,051,978 | 9/1962 | Auffrey | 15/312 |
| 3,072,321 | 1/1963 | King, Jr. | 230/255 |
| 3,459,010 | 8/1969 | Ferri | 15/301 X |
| 3,545,029 | 12/1970 | Walmsley et al. | 15/314 |
| 3,571,840 | 3/1971 | Gleaton et al. | 15/312 |
| 3,783,648 | 1/1974 | Heinrichs | 66/168 |
| 4,505,136 | 3/1985 | Tsay | 66/168 |
| 4,540,138 | 9/1985 | Gutschmit | 242/131 |
| 4,691,536 | 9/1987 | Yorisue et al. | 66/168 |
| 4,915,835 | 4/1990 | Barzuza et al. | 210/350 |
| 4,948,067 | 8/1990 | Gutschmit | 242/131 |
| 5,175,905 | 1/1993 | Gutschmit | 15/312.1 |
| 5,177,985 | 1/1993 | Igarashi et al. | 66/168 |

FOREIGN PATENT DOCUMENTS 2842819 4/1980 Germany .

OTHER PUBLICATIONS

Brochure of Texma Luigs GmbH; Hamburg, Germany; date unknown. (Handwritten date Sep. 1980 unverified).

Brief news article entitled "Paepke Lint Blower," *Knitting International*, Mar. 1984.

Advertisement re "Roll Kleen System" appearing in *Knitting Times*, Apr. 1994, p. 11.

Advertisement re "Roll Kleen System" appearing in *Knitting Times*, May 1994, p. 11.

Advertisement re "Sweep–Kleen" lint removal system appearing in *ATME–I* '93 Preview, p. 23.

Bulletin of Uniwave, Inc. re "Keep–Kleen", Bulletin No. 245–000–0502.

Bulletin of Uniwave, Inc. re "Sweep Kleen" Oscillating Fan System, Bulletin No. 260–000–0500.

Bulletin of Uniwave, Inc. re "Keep Kleen" Lint Removal Blower Systems, Bulletin No. 241–000–0520.

*Primary Examiner*—John J. Calvert

*Attorney, Agent, or Firm*—Shefte, Pinckney & Sawyer

[57] ABSTRACT

A debris cleaning apparatus for a circular knitting machine includes a horizontal radial support arm rotatably mounted coaxially to the machine frame with a rotary paddle-type fan mounted to one outward end of the support arm for movement within a circular range of motion and a counterweight mounted to the other outward end of the support arm. A drive motor imparts circular motion to the fan either in a vertical plane or in a conical path of motion, wherein the line of force of the fan is substantially maintained out of co-planar relation with the central axis of the machine. In this manner, the moving airstream generated by the fan provides a motive force for propelling the support arm to rotate about the central axis at a cyclically varying speed of rotation, either reversingly or in a single rotational direction. Thus, the airstream is directed through its range of movement over the knitting and yarn feeding instrumentalities of the machine about its full circumferential extent to blow lint from surfaces. In another embodiment, two auxiliary fans are operated alternately to propel the support arm reversibly in opposite directions.

37 Claims, 4 Drawing Sheets

DEBRIS CLEANING APPARATUS FOR CIRCULAR KNITTING MACHINES AND LIKE TEXTILE MACHINES

BACKGROUND OF THE INVENTION

The present invention relates to apparatus for controlling lint, dust and other debris in textile plants and, more specifically, to an apparatus particularly adapted to be mounted on a circular knitting machine or like textile machine to remove such debris therefrom and to limit debris accumulation thereon.

At substantially all stages of the processing of textile fibers, particularly cotton, from the initial fiber cleaning and preparation stage through yarn spinning and fabric production, the necessary handling of the textile fibers and yarns inherently liberates minute pieces of fiber, commonly referred to as lint, as well as other particulate dust and debris which tend to become readily airborne within the work area of the textile processing plant and ultimately to settle and accumulate on machinery and other exposed surfaces within the plant interior. Lint, dust and other debris pose a variety of problems to the textile manufacturer. For example, in fabric production operations, airborne lint and dust which settle on the processing machinery or on the yarn being utilized may cause defects in the fabric being produced and may adversely affect the proper operation of the fabric-producing machinery, in turn affecting operating efficiency and revenues.

One type of textile fabric-producing machine which is particularly subject to these problems is a circular knitting machine. In particular, large-diameter circular knitting machines may have a cylinder diameter of several feet with hundreds or even thousands of needles slidably supported in axial needle slots in the cylinder periphery and a corresponding number of needles, sinkers or other knitting instruments in radial slots in a cooperating dial concentric with the cylinder. Such knitting machines typically also have numerous yarn feeding stations spaced about the circumference of the cylinder each supplied from overhead with one or more individual yarns traveling through a series of stop motions and/or yarn storage feeding devices. In such circular knitting machines, it is important to prevent or at least minimize lint and other debris accumulation on the individual yarns as they are fed, on the instruments through which they are fed (e.g., stop motions, storage feeders, etc.) and on the knitting needles and the associated operative components and surfaces of the needle cylinder and dial of the knitting machine in order to promote cleanliness of the yarns and proper operation of the knitting instrumentalities of the machine.

U.S. Pat. No. 5,175,905, commonly owned with the present invention, discloses a debris cleaning apparatus particularly adapted for mounting on a circular knitting machine of the aforedescribed type to remove accumulated debris therefrom and to limit further debris accumulation thereon, especially at the critical upper areas of the machine wherein yarn feeding and knitting takes place. Specifically, the apparatus of this patent includes a horizontal radial support arm rotatably mounted coaxial to the machine frame with a rotary paddle-type fan pivotably mounted to the outward end of the support arm for oscillating movement within a vertical plane. A drive motor rotates the support arm and fan as a unit while simultaneously imparting oscillating movement to the fan through an eccentrically driven actuating arm. In this manner, a moving airstream generated by the fan is directed through the range of its oscillating movement over the knitting and yarn feeding instrumentalities of the machine about its full circumferential extent to blow lint from the surfaces.

A comparable rotating and oscillating fan system is also produced and sold by Uniwave, Inc. of Farmingdale, N.Y., under the trade designation "SweepKleen" and a similar rotating fan system wherein the fan revolves three hundred sixty degrees (360°) about the end of the rotating radial arm is produced by Uniwave, Inc., under the designation "Roll Kleen System". Another fan system produced by Uniwave, Inc. under the designation "KeepKleen" utilizes the motive force of the of the airstream generated by the fan for propelling the fan apparatus in a continuous rotary direction about the knitting machine.

SUMMARY OF THE INVENTION

It is an object of the present invention to provide an improved debris cleaning apparatus for circular knitting machines which further improves on the basic invention and advantages of the debris cleaning apparatus of U.S. Pat. No. 5,175,905, and the known fan systems of Uniwave, Inc., described above. It is a further object of the present invention to provide a debris cleaning apparatus, generally of the type of said patent, whose structure and operation is substantially simplified from that of the known apparatus.

Briefly summarized, the debris cleaning apparatus of the present invention has in common with the invention of the aforesaid patent the provision of a paddle-type fan or other form of blower capable of producing a moving airstream, a central shaft or other appropriate means for defining a central axis of rotational movement, and a support arm or like structure extending outwardly from the central axis for mounting the blower at a radially outward spacing from the central axis. In accordance with the present invention, the blower mounting means includes an arrangement or means for moving the blower to direct its moving air stream in a defined path of cleaning movement, and associated means are provided for moving the mounting means rotatably about the central axis at alternatingly increasing and decreasing rotational speeds. Preferably, the blower moving means is arranged to direct the line of airstream emission from the blower in a path wherein the line of airstream emission is substantially maintained out of co-planar relation with the central axis for causing the moving airstream of the blower to propel the blower and its mounting means reversingly in opposite rotational directions about the central axis or otherwise to propel the blower and its mounting means at alternatingly increasing and decreasing rotational speeds about the axis.

In preferred embodiments, the blower is rotated as a unit to direct its line of airstream emission through a circular path of movement, which may be selectively adjusted such that the overall circular range of motion of the airstream forms a cone or, alternatively, forms a plane. Depending upon the conical or planar form of the overall circular motion of the airstream, and the orientation of the conical or planar range of motion relative to the central axis, the propelling force of the airstream on the mounting arm or other mounting means can be selectively adjusted to propel the blower and the mounting means alternatingly in opposite rotational directions about the central axis or at cyclically varying speeds in a single rotational direction about the axis. When the apparatus is arranged for reversing rotation of the blower and its mounting means oppositely about the central axis, it is considered preferable that the blower propel the mounting means at least approximately one full revolution during each alternating movement in one or both of the opposite rotational directions. While a continuous circular path of movement of the blower is considered preferable, it is also contemplated that the blower may be arranged to move its line of airstream emission oscillatingly through an arcuate path of movement. Preferably, an electrical slip ring assembly is provided at the central axis for supplying operating electrical power to the blower and to the means by which the blower is moved in its defined circular or oscillating path.

In another embodiment, the blower support arm has first and second ends extending in opposite directions outwardly from the central shaft, with the debris cleaning blower movably mounted at one end of the support arm and two propelling blowers mounted in opposing orientations with respect to the circumferential path of travel of the second end of the support arm to exert opposing forces for tending to propel the support arm in opposing rotational directions. The two propelling blowers are operated selectively in order to accomplish reversible or other variable speed rotation of the support arm about the central upstanding shaft.

DESCRIPTION OF THE PREFERRED EMBODIMENT

Figure 1:
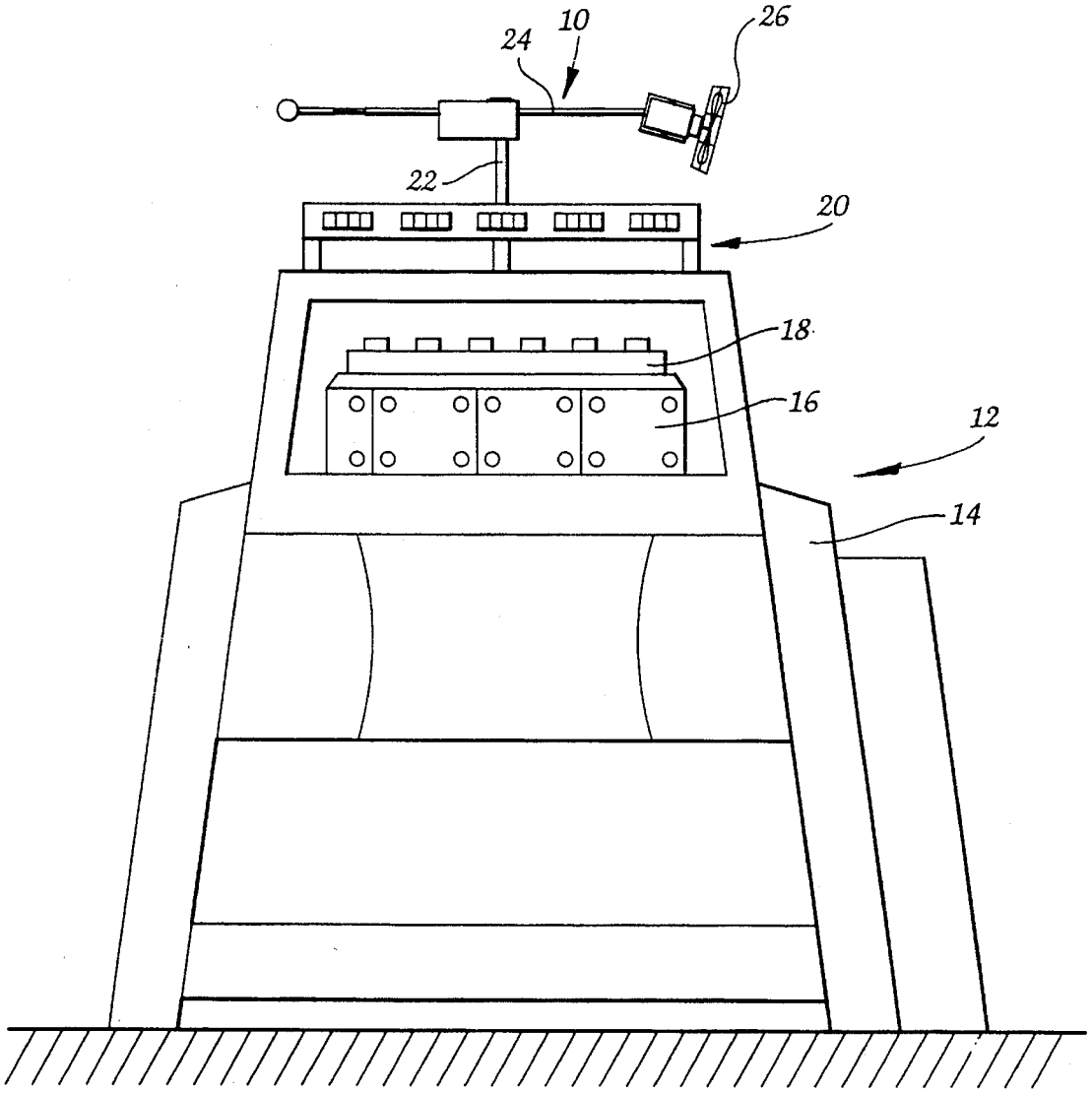
FIG. 1 is a schematic side elevational view of a representative conventional circular knitting machine having the debris cleaning apparatus according to one preferred embodiment of the present invention installed thereon.

Referring now to the accompanying drawings and initially to FIG. 1, the debris cleaning apparatus of the present invention is shown generally at 10 in its preferred installation mounted vertically above and concentric with a circular textile knitting machine, representatively indicated at 12. As will be understood, the debris cleaning apparatus 10 may be installed on virtually any conventional circular knitting machine, the machine 12 being intended to be characteristically representative of any such machine. Specifically, the circular knitting machine 12 basically comprises a frame 14 supporting an upright rotary needle cylinder 16 formed about the entirety of its periphery with plural axial needle slots in the upper ends of which knitting needles are slidably supported. A circular dial plate 18 is supported horizontally at the upper end of the needle cylinder 16 for integral rotation therewith, the dial 18 being formed with a corresponding number of radial slots in which another set of knitting instruments (needles, sinkers, or the like) are slidably supported for knitting manipulation in conjunction with the cylinder needles. Multiple knitting stations spaced circumferentially about the cylinder 16 and dial 18 are supplied with individual yarns from an associated yarn package creel (not shown) downwardly through an elevated series of yarn guiding elements usually including stop motions and/or storage feeding devices, generally represented at 20, typically disposed generally directly above the knitting stations.

Figure 2:
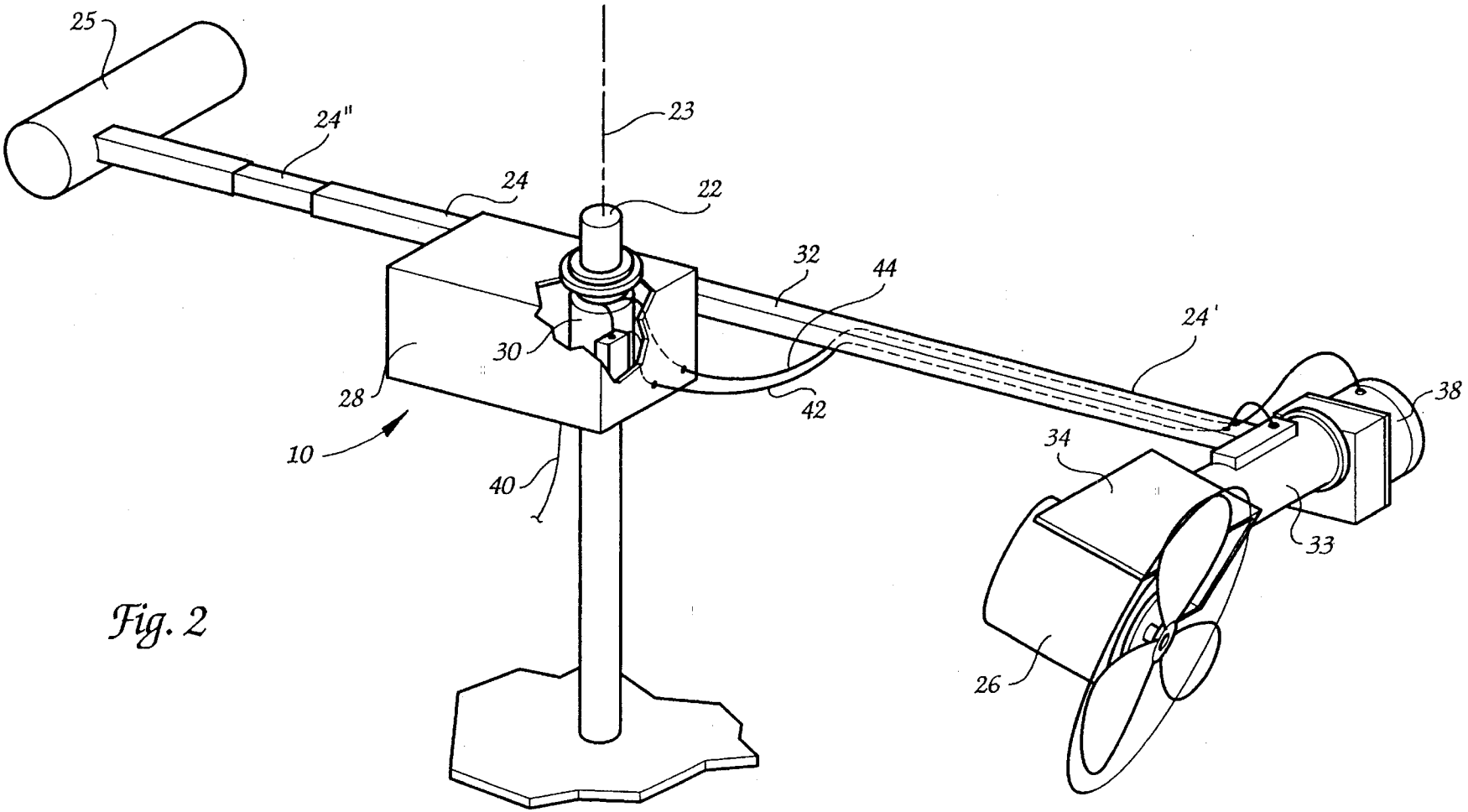
FIG. 2 is an enlarged top perspective view of the debris cleaning apparatus of FIG. 1, partially broken away to illustrate internal components thereof.

The particular construction of the debris cleaning apparatus 10 is best seen in FIG. 2. An upright shaft 22 is affixed centrally to the upper end of the knitting machine frame 14 to extend in upstanding relation therefrom substantially coaxially therewith to define a central rotational axis 23 for the apparatus 10. A support arm assembly 24 is rotatably supported on the shaft 22 for rotation about the axis 23 with opposite ends 24', 24" extending horizontally outwardly therefrom in radial relation to the circular knitting machine 12. A debris cleaning blower 26, preferably in the form of an electrically-operated rotary paddle-type fan, is mounted at one outward extending end 24' of the support arm assembly 24, while a counterweight 25 is mounted at the oppositely extending end 24" of the support arm assembly 24.

The support arm assembly 24 includes a box-shaped housing 28 centrally along its overall length, which is supported on the upright shaft 22 by an electric slip ring assembly 30. A telescoping tubular arm 32 is affixed to and extends outwardly from one side of the housing 28 and extends outwardly therefrom in opposite endwise directions to form the opposite ends 24', 24" of the support arm assembly 24. A clevis member 34 is rotatably affixed to one lateral side of the outwardly extending end 24' of the telescoping arm 32 by another electrical slip ring assembly 33 and pivotably supports the housing of the fan 26 for pivoting movement about an axis 36 in a vertical plane substantially parallel to the support arm 32. The slip ring assembly 33 defines a rotational axis 37 for the clevis member 34 which extends perpendicularly to both the support arm 32 and the pivot axis 36 of the fan 26. A drive motor 38 is affixed to the stationary housing of the slip ring assembly 33 for driving rotation of the clevis member 34 integrally with the rotational component of the slip ring assembly 33.

Electrical operating power is delivered into the housing 28 through a suitable lead 40 to the slip ring assembly 30. The slip ring assembly 30, in turn, transmits electrical power through a first output lead 42 extending along the arm 32 to the slip ring assembly 33 for transmission by a lead (not shown) to the motor of the fan 26 and likewise transmits electrical power through a second output lead 44 also extending along the arm 32 to the drive motor 38.

A significant feature and advantage of the apparatus of the present invention is that the force of the moving airstream generated by the fan 26 not only accomplishes cleaning of debris from the componentry of the knitting machine within the path of the airstream but also provides the motive force for propelling the support arm assembly 24 rotatably about the axis 23 of the upright shaft 22. For this purpose, the slip ring assembly 33 and the clevis member 34 cooperate to dispose the axis 37 about which the fan 26 pivots relative to the clevis member 34 in a vertical plane which does not intersect the central rotational axis 23 of the support arm assembly 24 but rather is spaced laterally from the axis 23. Thus, at any pivoted disposition of the fan 26 relative to the clevis member 34, the line of force produced by the fan 26, i.e., the line of airstream emission generated by the fan 26, will be substantially out of co-planar relation with the central axis 23 throughout substantially the entirety of the rotational movement of the clevis member 34 by the drive motor 38. As a result, a moment of force, i. e., torque, is created between the fan 26 and the support arm assembly 24 at substantially every momentary rotational disposition of the fan 26 throughout the rotational range of the clevis member 34, by which the force of the airstream from the fan 26 produces an opposing rotational movement of the support arm assembly 24 about the shaft 22.

As will be understood, the progressively changing disposition of the fan 26 resulting from the rotation of the clevis member 34 by the drive motor 38 causes the instantaneous moment of force to progressively change in a repeating cycle over the course of operation of the apparatus 10, which will produce a cyclically alternating acceleration and deceleration of the rotational movement of the support arm assembly 24 about the central shaft 22. Depending upon the pivoted disposition of the fan 26 relative to the clevis member 34, the support arm assembly 24 may be caused to be reversibly propelled alternatingly in opposite rotational directions about the central axis 23 or to maintain rotation in a single direction about the central axis 23 while alternatingly accelerating and decelerating in rotational speed.

Figure 3A:
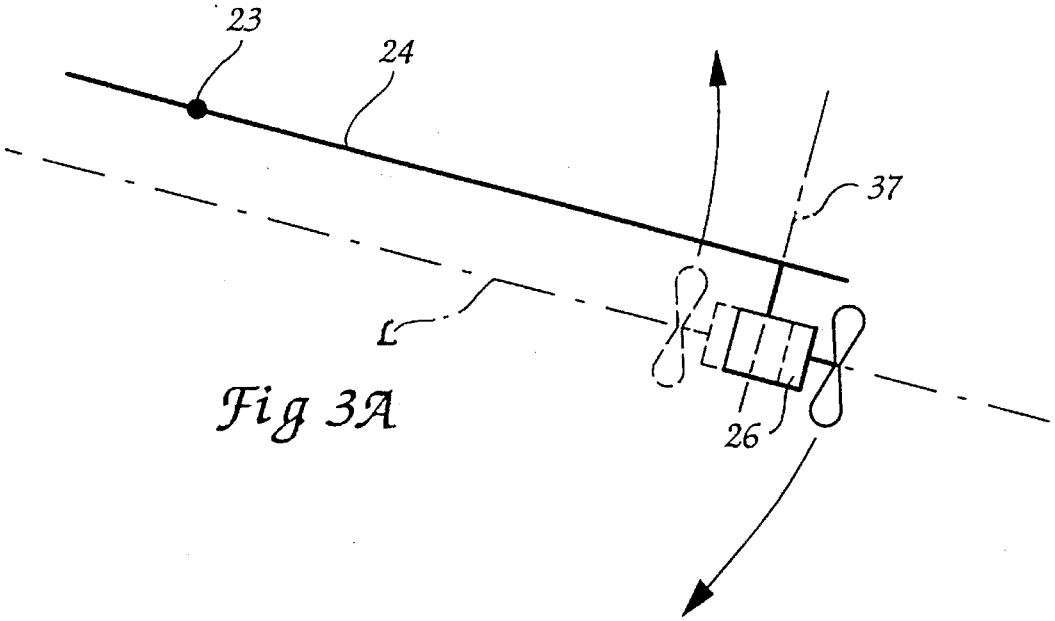
FIGS. 3A and 3B are schematic top plan views of the debris cleaning apparatus of FIGS. 1 and 2, adjusted selectively for three differing modes of operation.
Figure 3B:
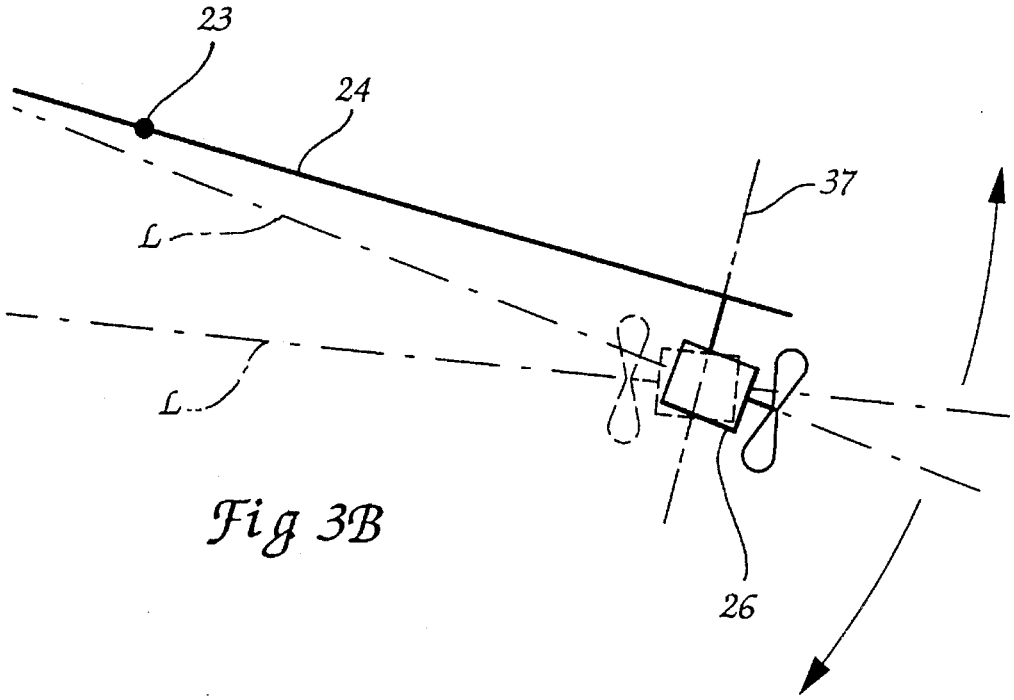

For example, with reference to FIGS. 3A and 3B, the operation of the present apparatus is schematically depicted with the fan 26 in differing pivoted orientations relative to the clevis member 34. In FIG. 3A, the fan 26 is disposed such that the axis of its paddle wheel, i.e., the axial line of force of the moving airstream generated by the fan, indicated at L, is precisely perpendicular to the rotational axis 37 of the clevis member 34. Thus, the infinite instantaneous orientations of the line of fan force L throughout the rotational movement of the clevis member 34 collectively define a vertical plane within which the line of force L is maintained throughout operation of the apparatus 10, which plane is precisely parallel to, and does not intersect with, the central axis 23 of the shaft 22. As a result, the moment of force produced by the fan 26 is always maintained within the same vertical plane, producing a maximum force for rotating the support arm assembly 24 in a counterclockwise direction (as viewed in top plan in FIG. 3A) when the line of fan force L is directed horizontally outwardly away from the central axis 23 (shown in full lines) and a maximum force producing opposite clockwise rotation of the support arm 24 when the line of fan force L is directed horizontally inwardly toward the axis 23 (as shown in broken lines). When the line of fan force L is directed vertically upwardly or downwardly so as to be parallel to the central axis 23 (the only momentary instances in which the line L is co-planar with the axis 23), the moment of force has a zero value. As an overall net result, the support arm assembly 24 is propelled reversingly by the fan 26 alternately in opposite clockwise and counterclockwise directions about the central axis 23, progressively accelerating and decelerating in one direction and then accelerating and decelerating in the opposite direction.

In contrast, in the orientation of the fan 26 depicted in FIG. 3B, the fan 26 is pivoted slightly with respect to the clevis member 34 whereby the infinite instantaneous lines of fan force L throughout the rotational movement of the clevis member 34 collectively define a conical path through which the generated airstream moves. When the clevis member 34 rotates the fan 26 into the instantaneous disposition wherein the line of force L extends horizontally inwardly relative to the central axis 23, a maximum moment of force is created tending to rotate the support arm assembly 24 clockwise about the central axis 23, as depicted in broken lines. On the other hand, when the fan 26 is rotated by the clevis member 34 into the instantaneous disposition wherein the line of force L extends horizontally outwardly from the central axis 23, a maximum moment of force is produced tending to rotate the support arm assembly 24 in a counterclockwise direction about the axis 23, as depicted in full lines. However, as will be seen, the moment of clockwise-propelling force substantially exceeds the moment of counterclockwise-propelling force so that the moment of clockwise-propelling force is incapable of overcoming the counterclockwise inertia of the support arm assembly 24 and, thus, only serves to substantially decelerate the rotational speed, but not to reverse the rotational direction of the support arm assembly 24. The support arm assembly 24 therefore accelerates and decelerates alternatingly while always maintaining a clockwise rotational direction.

In normal operation, the debris cleaning apparatus 10 is initially set up by extending the telescoping support arm 32 to an effective length sufficient to dispose the fan 26 generally directly above the outer periphery of the cylinder and dial 16, 18 and thereby either laterally adjacent or generally above the yarn feeding components associated with the knitting stations, such as the storage feeders and/or stop motions 20 and other yarn guiding elements.

Upon energization of the slip ring assembly 30, electrical power is supplied to the drive motor 38 and simultaneously to the motor of the fan 26, energizing the fan 26 and causing it simultaneously to move in a continuous circular path of travel, either within a vertical plane of movement or in a conical path of motion. As indicated above, depending upon the conical or planar form circumscribed by the airstream of the rotating fan 26, the airstream propels the support arm assembly 24 about the axis 23 of the central shaft 22 at alternatingly increasing and decreasing rotational speeds, either in a single rotational direction or reversingly in opposite rotational directions. With the paddle wheel of the fan 26 being continuously driven as the support arm assembly 24 rotates and as the clevis member 34 simultaneously rotates, the moving airstream generated by the fan 26 is directed within a full circular range of motion over the full circumferential extent of the circular knitting machine 12, thereby blowing the airstream over the slots, the needles, and other knitting instruments within the cylinder and dial 16,18, and over the storage feeders and/or stop motions 12 and other yarn guiding elements, both above and below the height of the apparatus 10 to blow accumulated lint and debris off these machine components and to limit further debris accumulation thereon. In embodiments of the apparatus wherein the direction of rotation of the support arm assembly 24 reverses alternatingly, these various instrumentalities and areas of the knitting machine are exposed to the airstream created by the fan 26 while moving in differing rotational directions, which serves to enhance the debris cleaning effect, e.g., by enabling lint and debris to be blown from the knitting machine when the fan 26 is traveling in one rotational direction whereas the lint and debris might not be successfully blown from the machine while the fan 26 is traveling in the opposite rotational direction. Regardless, the inherent variation in the rotational traveling speed of the support arm assembly 24 accomplished in each embodiment of the apparatus 10 produces a concentrated air flow during periods when the arm assembly 24 is reversing directions or otherwise decelerating, to further enhance the cleaning effect.

Figure 4:
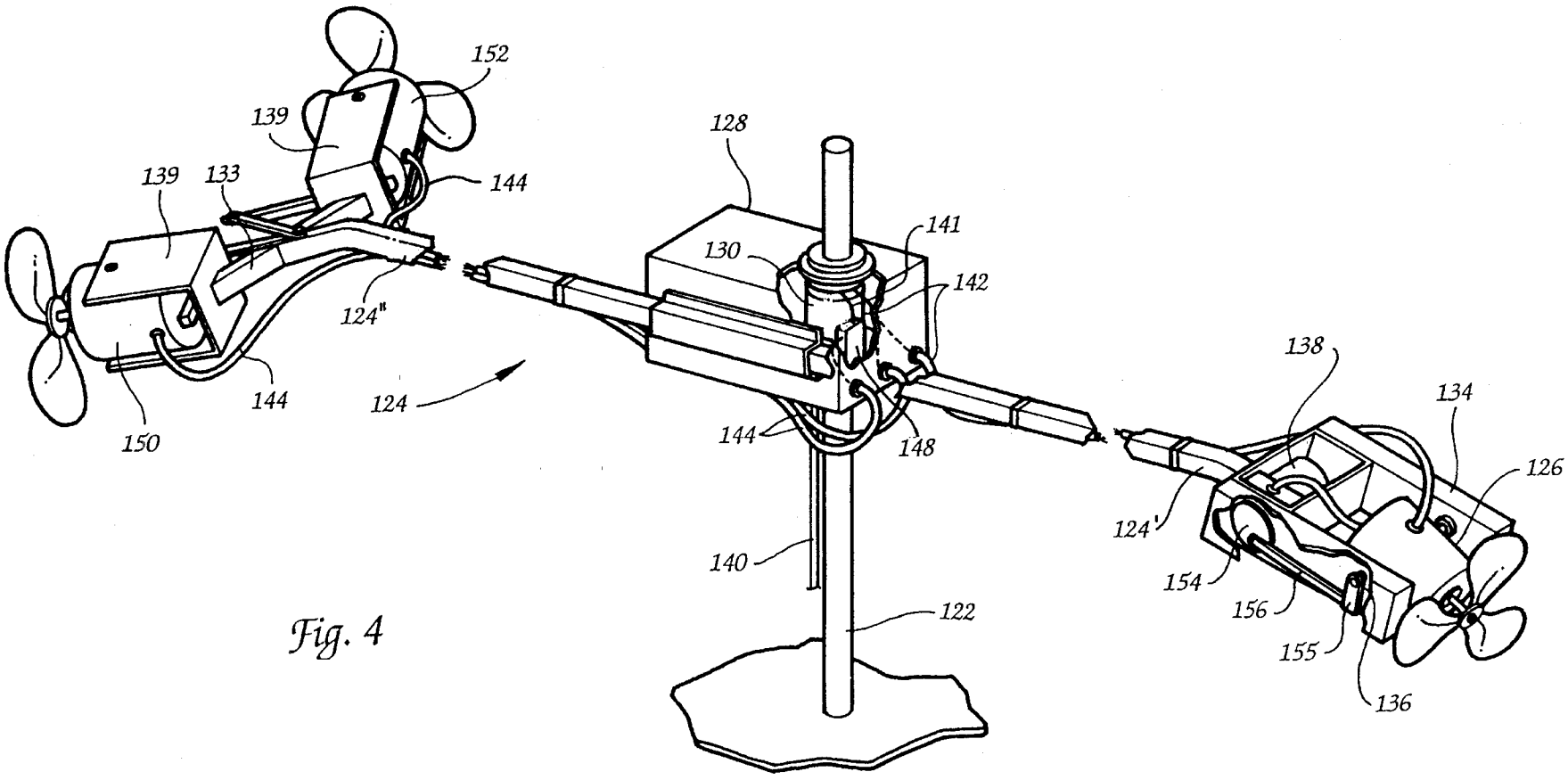
FIG. 4 is a top perspective view similar to FIG. 2, illustrating an alternative embodiment of the debris cleaning apparatus.

With reference now to FIG. 4, an alternative embodiment of the debris cleaning apparatus is indicated at 110. In this embodiment, a clevis member 134 is affixed directly to one end 124' of the support arm assembly 124, while a pair of fan-type propelling blowers 150,152 are mounted at the oppositely extending end 124" of the support arm assembly 124. The fan 126 is pivoted to the clevis member 134 for pivoting movement within a generally vertical plane of movement about a substantially horizontal pivot axis 136. A transverse mounting bar 133 is affixed perpendicularly to the outward end 124" of the support arm assembly 124 and supports a pair of laterally spaced clevis members 139 disposed angularly in diverging relation to one another, each clevis member 139 supporting pivotably the housing of one respective propelling blower 150,152.

Another motor 138 is mounted within the clevis member 134 stationarily to its base. A drive disk 154 is affixed coaxially to the drive shaft of the motor 138 to be drivenly rotated therewith. An elongate actuating arm 156 is affixed at one end eccentrically to the drive disk 154 and at the other end eccentrically to a lever arm 155 mounted to the pivot axis 136 of the housing of the fan 126. In this manner, rotational movement imparted to the drive disk 154 by the motor 138 is translated into reciprocating motion of the actuating arm 156 to pivotably oscillate the fan 126 within a range of vertical motion determined by the eccentric mounting of the actuating arm 156.

Electrical operating power is delivered into the housing 128 through a suitable lead 140 to the slip ring assembly 130 which, in turns, transmits electrical power to the motor of the fan 126 and to the drive motor 138 through a common output lead 142 extending along the arm 124' and to the respective motors of the fans 150,152 through an output lead 141 into a control unit 148 from which separate output leads 144 extend along the opposing arm 124".

The propelling fans 150,152 are pivotably oriented on their respective clevis members 139 to face angularly in opposing directions relative to the circumferential path of travel followed by the extending end 124" of the support arm assembly 124. In this manner, upon energization of either one of the fans 150,152, the force of the airstream created serves to drive the support arm assembly 124 in an opposing rotational direction about the upright shaft 122. The pivotal mounting of each fan 150,152 enables its particular orientation to be selectively adjusted so as to control the vector relationship of the fan's airstream to the circumferential path of rotation of the support arm assembly 124 and thereby to control the rotational speed imparted to the support arm assembly. Within the housing 128, electrical output leads 144 to the fans 150,152 are connected to the control unit 148 which is equipped with a switching device operative to deliver operating electrical power only alternatingly to the respective leads 144 so that only one of the propelling fans 150,152 is operative at any given time. The control unit 148 preferably is equipped with a timer (not shown) to operate the switching device at regular predetermined intervals for alternating actuation of the fans 150,152 at desired intervals.

In normal operation, upon energization of the slip ring assembly 130, electrical power is supplied to the drive motor 138 and simultaneously to the motor of the fan 126, energizing the fan 126 and causing it simultaneously to oscillate within a vertical plane of movement. At the same time, electrical power is supplied through the slip ring assembly 130 to energize the control unit 148 and its switching and timing devices, which in turn operate to alternatingly energize the propelling fans 150,152 to rotatably drive the support arm assembly 124 alternatingly in opposite rotational directions. The timing device within the control unit 148 and the angular orientation of the propelling fans 150,152 may be selectively adjusted to control the speed of rotation of the support arm assembly 124 and its rotational extent of travel each time each individual fan 150,152 is energized.

As will be understood, upon each switching alternation of the propelling fans 150,152, the inherent momentum of the support arm assembly 124 created by the just de-energized fan will initially counteract the propelling force of the newly energized fan and thereby cause the support arm assembly to decelerate and experience a temporary dwell before reversing rotational direction. In turn, the debris cleaning force of the oscillating fan 126 will be essentially concentrated at the circumferential location on the knitting machine at which the support arm assembly 124 reverses its rotational direction. By selective control of the rotational speed of the support arm assembly 124 and setting of the timing device, each reversal can be controlled to occur at differing random circumferential locations on the knitting machine or, alternatively, at the same circumferential location on the knitting machine which, in turn, can be selected to occur at a particular location at which concentrated debris cleaning could be desirable, e.g., at the location of the quality wheel on the knitting machine.

With the paddle wheel of the fan 126 being continuously driven as the support arm assembly 124 rotates and the fan 126 oscillates, the moving airstream generated by the fan 126 is directly downwardly and outwardly within the defined range of oscillating movement over the full circumferential extent of the circular knitting machine 12, thereby blowing the airstream over the slots, the needles, and other knitting instruments within the cylinder and dial 16,18 and over the storage feeders and/or stop motions 20 and other yarn guiding elements to blow accumulated lint and debris off these machine components and to limit further debris accumulation thereon. By continually reversing the direction of rotation of the support arm assembly 124, these various instrumentalities and areas of the knitting machine are exposed to the airstream created by the fan 126 while moving in differing rotational directions, serving as aforementioned to enhance the debris cleaning effect of the present apparatus. In addition, the airstreams created by the propelling fans 150,152, while not specifically intended to accomplish debris cleaning and to prevent debris accumulation, still provides some degree of supplementary cleaning benefit.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. Apparatus for cleaning debris from, and preventing settlement of debris on, a textile machine, comprising means defining a central axis of rotational movement, a blower for producing a moving airstream, means for mounting said blower to said central axis defining means at a radially outward spacing from said central axis, means for moving said blower relative to said mounting means to direct said moving airstream in a defined path of cleaning movement, repetitively over the course of normal cleaning operation and means for moving said mounting means rotatably about said central axis at alternatingly increasing and decreasing rotational speeds repetitively over the course of normal cleaning operation.

2. Apparatus for cleaning debris from, and preventing settlement of debris on, a textile machine according to claim 1, wherein said blower moving means directs said airstream of said blower through an arcuate path of movement.

3. Apparatus for cleaning debris from, and preventing settlement of debris on, a textile machine according to claim 2, wherein said blower moving means directs said airstream of said blower through a circular path of movement.

4. Apparatus for cleaning debris from, and preventing settlement of debris on, a textile machine according to claim 3, wherein said blower moving means moves said airstream of said blower continuously in said circular path of movement.

5. Apparatus for cleaning debris from, and preventing settlement of debris on, a textile machine according to claim 1, wherein said central axis defining means comprises an electrical slip ring assembly for supplying operating electrical power to said blower and to said blower moving means.

6. Apparatus for cleaning debris from, and preventing settlement of debris on, a textile machine according to claim 1, wherein said means for moving said mounting means reverses said mounting means alternatingly in opposite rotational directions about said central axis.

7. Apparatus for cleaning debris from, and preventing settlement of debris on, a textile machine according to claim 1, wherein said means for moving said mounting means rotates said mounting means in a single rotational direction about said central axis.

8. Apparatus for cleaning debris from, and preventing settlement of debris on, a textile machine, comprising means defining a central axis of rotational movement, a blower for producing a moving airstream, means for mounting said blower to said central axis defining means at a radially outward spacing from said central axis, means for moving said blower relative to said mounting means to direct the moving airstream in a defined path of cleaning movement repetitively over the course of normal cleaning operation for propelling said blower and said mounting means rotatably about said central axis at alternatingly increasing and decreasing rotational speeds repetitively over the course of normal cleaning operation.

9. Apparatus for cleaning debris from, and preventing settlement of debris on, a textile machine, comprising means defining a central axis of rotational movement, a blower for producing a moving airstream generally along a line of emission, and means for mounting said blower to said central axis defining means at a radially outward spacing from said central axis, means for moving said blower relative to said mounting means to direct said line of emission in a defined path repetitively over the course of normal cleaning operation wherein said line of emission of said blower is substantially maintained out of co-planar relation with said central axis for causing said moving airstream of said blower to propel said blower and said mounting means about said central axis at alternatingly increasing and decreasing rotational speeds repetitively over the course of normal cleaning operation.

10. Apparatus for cleaning debris from, and preventing settlement of debris on, a textile machine, according to claim 9 and wherein said blower moving means directs said line of emission of said blower through an arcuate path of movement.

11. Apparatus for cleaning debris from, and preventing settlement of debris on, a textile machine, according to claim 10 and wherein said blower moving means directs said line of emission of said blower through a circular path of movement.

12. Apparatus for cleaning debris from, and preventing settlement of debris on, a textile machine, according to claim 11 and wherein said blower moving means moves said airstream of said blower continuously in said circular path of movement.

13. Apparatus for cleaning debris from, and preventing settlement of debris on, a textile machine, according to claim 11 and wherein said circular path of movement of said line of emission forms a conical range of said airstream.

14. Apparatus for cleaning debris from, and preventing settlement of debris on, a textile machine, according to claim 11 and wherein said circular path of movement of said line of emission forms a planar range of said airstream.

15. Apparatus for cleaning debris from, and preventing settlement of debris on, a textile machine, according to claim 13 or 14, wherein said blower moving means causes said moving airstream of said blower to reversibly propel said blower and said mounting means alternatingly in opposite rotational directions about said central axis.

16. Apparatus for cleaning debris from, and preventing settlement of debris on, a textile machine, according to claim 13 or 14, wherein said blower moving means causes said moving airstream of said blower to propel said blower and said mounting means in a single rotational direction about said central axis.

17. Apparatus for cleaning debris from, and preventing settlement of debris on, a textile machine, according to claim 9, wherein said central axis defining means comprises an electrical slip ring assembly for supplying operating electrical power to said blower and to said blower moving means.

18. Apparatus for cleaning debris from, and preventing settlement of debris on, a textile machine, comprising means defining a central axis of rotational movement, a blower for producing a moving airstream generally along a line of emission, and means for mounting said blower to said central axis defining means at a radially outward spacing from said central axis, means for moving said blower relative to said mounting means to direct said line of emission in a defined path repetitively over the course of normal cleaning operation wherein said line of emission of said blower is substantially maintained out of co-planar relation with said central axis for causing said moving airstream of said blower to reversibly propel said blower and said mounting means alternatingly in opposite rotational directions about said central axis repetitively over the course of normal cleaning operation.

19. Apparatus for cleaning debris from, and preventing settlement of debris on, a textile machine, according to claim 18 and wherein said blower moving means directs said line of emission of said blower through an arcuate path of movement.

20. Apparatus for cleaning debris from, and preventing settlement of debris on, a textile machine, according to claim 19 and wherein said blower moving means directs said line of emission of said blower through a circular path of movement.

21. Apparatus for cleaning debris from, and preventing settlement of debris on, a textile machine, according to claim 20 and wherein said blower moving means moves said airstream of said blower continuously in said circular path of movement.

22. Apparatus for cleaning debris from, and preventing settlement of debris on, a textile machine, according to claim 20 and wherein said circular path of movement of said line of emission forms a conical range of said airstream.

23. Apparatus for cleaning debris from, and preventing settlement of debris on, a textile machine, according to claim 20 and wherein said circular path of movement of said line of emission forms a planar range of said airstream.

24. Apparatus for cleaning debris from, and preventing settlement of debris on, a textile machine, according to claim 18, wherein said central axis defining means comprises an electrical slip ring assembly for supplying operating electrical power to said blower and to said blower moving means.

25. Apparatus for cleaning debris from, and preventing settlement of debris on, a textile machine, according to claim 18 and wherein said blower moving means is arranged to propel said blower and said mounting means at least approximately one full revolution during each alternating movement in at least one of the opposite rotational directions.

26. Apparatus for cleaning debris from, and preventing settlement of debris on, a textile machine, according to claim 25 and wherein said blower moving means is arranged to propel said blower and said mounting means at least approximately one full revolution during each alternating movement in each of the opposite rotational directions.

27. Apparatus for removing debris from a circular knitting machine comprising:

an upstanding shaft mounted centrally above said knitting machine, a support arm extending radially outwardly from said shaft, a blower mounted at the extending end of said support arm, means for moving said blower relative to said support arm through a predetermined range of motion repetitively over the course of normal cleaning operation; and means for rotating said support arm about said shaft at varying speeds repetitively over the course of normal cleaning operation simultaneously with movement of said blower by said blower moving means for directing a moving airstream over a predetermined area of said knitting machine to blow debris therefrom and limit debris accumulation thereon.

28. Apparatus for removing debris from a circular knitting machine according to claim 27, wherein said support arm rotating means includes means for reversibly rotating said support arm alternatingly in opposite directions about said shaft.

29. Apparatus for removing debris from a circular knitting machine according to claim 28, wherein said reversibly rotating means comprises means for rotating said support arm at least one full revolution during each alternating movement in at least one of the opposite rotational directions.

30. Apparatus for removing debris from a circular knitting machine according to claim 28, wherein said rotating means comprises means for rotating said support arm at least one full revolution during each alternating movement in each of the opposite rotational directions.

31. Apparatus for removing debris from a circular knitting machine according to claim 27, wherein said support arm comprises a second end extending radially outwardly from said shaft generally oppositely to said first-mentioned extending end, and said rotating means comprises blower means arranged at said second extending end of said support arm for propelling said support arm alternatingly in said opposite directions.

32. Apparatus for removing debris from a circular knitting machine according to claim 31, wherein said blower means is switchable between at least two operating modes for selectively propelling said support arm in said opposite directions and at varying speeds.

33. Apparatus for removing debris from a circular knitting machine according to claim 32, wherein said blower means comprises two propelling blowers disposed at said second extending end of said support arm in opposing orientations with respect to the circumferential path of travel of said second extending end of said support arm to exert opposing forces for selectively propelling said support arm in opposing directions and at varying speeds.

34. Apparatus for removing debris from a circular knitting machine according to claim 33, wherein said rotating means comprises means for independently operating said two propelling blowers.

35. Apparatus for removing debris from a circular knitting machine according to claim 34, wherein said rotating means comprises means for selectively controlling each operation of each propelling blower.

36. Apparatus for removing debris from a circular knitting machine according to claim 27 and further comprising a slip ring mounting said support arm to said shaft for transmitting electrical operating power to said blower.

37. Apparatus for removing debris from a circular knitting machine comprising:

an upstanding shaft mounted centrally above said knitting machine, a support arm extending radially outwardly from said shaft, a first blower mounted at one end of said support arm, means for moving said first blower relative to said mounting means through a predetermined range of motion repetitively over the course of normal cleaning operation; and a second blower mounted at the other end of said support arm for rotating said support arm about said shaft simultaneously with movement of said first blower by said blower moving means for directing the moving airstream of said first blower over a predetermined area of said knitting machine to blow debris therefrom and limit debris accumulation thereon.

* * * * *